US007147726B2

(12) United States Patent
Lu et al.

(10) Patent No.: US 7,147,726 B2
(45) Date of Patent: Dec. 12, 2006

(54) MECHANICAL METHOD FOR GENERATING NANOSTRUCTURES AND MECHANICAL DEVICE FOR GENERATING NANOSTRUCTURES

(75) Inventors: Jian Lu, Troyes Cedex (FR); Ke Lu, Shenyang (CN)

(73) Assignees: Universite de Technologie de Troyes (FR); The Institute of Metal Research (CN)

( * ) Notice: Subject to any disclaimer, the term of this patent is extended or adjusted under 35 U.S.C. 154(b) by 272 days.

(21) Appl. No.: 10/343,012

(22) PCT Filed: Jul. 27, 2001

(86) PCT No.: PCT/FR01/02483

§ 371 (c)(1),
(2), (4) Date: Jun. 2, 2003

(87) PCT Pub. No.: WO02/10463

PCT Pub. Date: Feb. 7, 2002

(65) Prior Publication Data

US 2004/0038626 A1 Feb. 26, 2004

(30) Foreign Application Priority Data

Jul. 28, 2000 (FR) ..... 00 09949

(51) Int. Cl.

| | |
|---|---|
| ***C23C 8/00*** | (2006.01) |
| ***C21D 8/00*** | (2006.01) |
| *B24B 39/00* | (2006.01) |
| *C21D 1/00* | (2006.01) |

(52) U.S. Cl. ..... 148/240; 29/90.07; 148/558; 148/537; 148/609

(58) Field of Classification Search ..... 148/241, 148/281, 284, 218, 240, 537, 558, 609; 72/53; 250/492.21; 29/90.07
See application file for complete search history.

(56) References Cited

U.S. PATENT DOCUMENTS

| | | | | |
|---|---|---|---|---|
| 2,460,657 | A | 2/1949 | Robinson | |
| 4,628,834 | A * | 12/1986 | McKelvie | 110/263 |
| 5,532,495 | A * | 7/1996 | Bloomquist et al. | 250/492.21 |

FOREIGN PATENT DOCUMENTS

WO WO 95 23876 A 9/1995

OTHER PUBLICATIONS

Tao N.R. et al. "Surface Nanocrystalization of Iron Induced by Ultrasonic Shot Peening" Nanostructured Materials, Elsevier, NY, vol. 11, No. 4, Jun. 1999; pp. 433-440; XP004178991 ISSN: 0965-9773, entire document.

* cited by examiner

*Primary Examiner*—Roy King
*Assistant Examiner*—Lois Zheng
(74) *Attorney, Agent, or Firm*—Miles & Stockbridge P.C.; Edward J. Kondracki

(57) ABSTRACT

The present invention concerns a mechanical method for generating nanostructures in order to obtain on a surface of a metal piece a nanostructured layer of defined thickness. A quantity of perfectly spherical balls (22) are disposed in a chamber that is closed for the size of the balls. At least one of the walls of the chamber supports or constitutes the piece to be treated (10). A vibrating motion is imparted to the chamber in a direction perpendicular to the plane of the circular motion of the chamber supporting or constituting the piece to be treated. The speed of the circular motion and the frequency and amplitude of the vibrating motion is determined based on the physical properties of the balls so as to communicate to the latter sufficient kinetic energy to create nanostructures on the material of the piece treated by impaction of the balloon surface of the piece.

17 Claims, 4 Drawing Sheets

MECHANICAL METHOD FOR GENERATING NANOSTRUCTURES AND MECHANICAL DEVICE FOR GENERATING NANOSTRUCTURES

CROSS REFERENCE TO RELATED APPLICATION

The subject matter of the subject invention is related to application Ser. No. 10/343,009 filed on May 5, 2003, in the names of Jian LU and Ke LU, "METHOD FOR GENERATING NANOSTRUCTURES AND DEVICE FOR TREATING NANOSTRUCTURES", the subject matter of which is incorporated herein in its entirety.

BACKGROUND OF THE INVENTION

1. Field of the Invention

The present invention concerns a mechanical method for generating nanostructures on metal pieces and a mechanical device for generating nanostructures.

Nanocrystalline materials are characterized by ultrafine grains, typically with at least one dimension of less than 100 nm. These materials are produced using known methods such as, for example, IGC (inert gas condensation and consolidation), SPD (severe plastic deformation), etc. These methods have the drawback of generating materials that are neither porosity-free nor contamination-free, nor of sufficient size for industrial applications.

The purpose of the method of the invention is to create on the surface of the material a layer of this same material having constituent grains of several tens of nanometers, forming what is commonly called a layer of nanometric microstructures, or nanostructures.

There are conventional peening methods that are known in the prior art. Peening the surface of a material, for example a metal, consists of shooting projectiles of small size, for example balls, at speeds between 5 and 100 mps. In this prior art, the balls are projected by means of a blast of compressed air. In this method of peening, the balls are not immediately reused, and pass through a recycling device before being fed back to the blast nozzle, or in the absence of a recycling device, the method requires a large quantity of balls. Moreover, each blast that is incident on the piece is unidirectional, at a given angle for a given surface. Furthermore, a continuous sweep of the piece is required during the peening in order to obtain a homogeneous surface. In addition, the results obtained show that the surface of the treated piece comprises few or no nanostructures. The only advantage of the conventional peening process resides in the fact that it is possible to obtain higher ball speeds than in the generation of nanostructures using ultrasound. In essence, projecting balls using ultrasound makes it possible to obtain ball speeds between 5 and 20 mps, whereas pneumatic blast nozzle peening makes it possible to obtain ball speeds between 10 and 100 mps.

2. Description of the Related Art

There is also a method for ultrasonic hardening of metal pieces known from French patent application 2,689,431 or Russian patent application 1,391,135, which consists of setting balls in motion inside an enclosed volume for a given amount of time, using an ultrasound generator. In the method of the French patent application, it is possible to obtain, as a function of the speed, either a given roughness, or a given hardened layer depth. In order to obtain a uniform treatment, the travel speed of the transmitter must conform to a certain value, below which there is strain hardening of the surface and above which the treatment is no longer uniform, meaning that some point on the surface will not have been hit even once. The speeds envisaged in this patent application are no more than several tens of centimeters per second, and the amplitude of the transmitter is 100 μm. Thus, the known operating mode does not make it possible to create a hardened layer without obtaining a nanometric structure to a significant depth.

SUMMARY OF THE INVENTION

The object of the present invention is to eliminate the drawbacks of the prior art by offering a method for generating nanostructures that makes it possible to obtain a nanostructured layer in a given thickness of the surface of a piece to be treated by means of a mechanical device using a limited quantity of balls in an enclosed volume. This method is also called surface nanocrystallization by ball milling.

This first object is achieved using a mechanical method for generating nanostructures to obtain on a surface of a metal piece a nanostructured layer of defined thickness, characterized in that it comprises:

a step for setting in a circular motion a quantity of perfectly spherical balls (22) disposed in a chamber that is closed for the size of the balls, at least one of whose walls supports or constitutes the piece to be treated (10);

a step for imparting a vibrating motion, in a direction perpendicular to the plane of the circulation motion of the chamber supporting or constituting the piece to be treated; the speed of the circular motion and the frequency and amplitude of the vibrating motion being determined based on the physical properties of the balls so as to communicate to the latter sufficient kinetic energy to create nanostructures on the material of the piece to be treated.

Another object of the invention consists of offering a mechanical device for generating nanostructures that makes it possible to obtain a nanostructured layer in a given thickness by means of a mechanical device using a limited quantity of balls in an enclosed volume. This object is achieved by means of the mechanical device for generating nanostructures in a metal piece comprising at least one chamber that is closed for the size of the balls, containing a given quantity of perfectly spherical balls of given dimensions, a means for linking the chamber to means for generating a vibration communicated to the chamber, the assembly of the chamber and vibrating means being mounted by shock absorbing means (31) on a plate (30) that rotates at a given speed.

BRIEF DESCRIPTION OF THE DRAWINGS

The invention and its characteristics and advantages will emerge more clearly with the reading of the description given in reference to the attached drawings, in which.

The principle of the invention is to perform a treatment of the surface of a metal piece in order to modify the mechanical properties of the metal piece and to modify the diffusion properties in the superficial layer of the treated surface.

In the prior art, the mechanical properties of nanometric microstructures, or nanostructures, are well known. In essence, the smaller the size of the metal grains, the greater the mechanical strength of the piece. Thus, current research is seeking to develop methods of fabrication for obtaining pieces constituted only of nanostructures. The subject of the invention is entirely different; it consists of using a process for generating nanostructures (described below) to create a superficial nanostructured layer that gives the surface of the piece the desired properties, for example mechanical properties, this being enough to guarantee the properties desired for the piece (fatigue strength, abrasion or friction resistance, corrosion resistance, etc.).

In order to obtain a nanostructure, it is necessary to reduce the size of the metal grains on the surface of the piece. Initially, for a piece made, for example, of pure iron, the grains have a dimension on the order of 100 μm. After the treatment according to the invention, the size of the grains is on the order of only several tens of nanometers.

Figure 1:
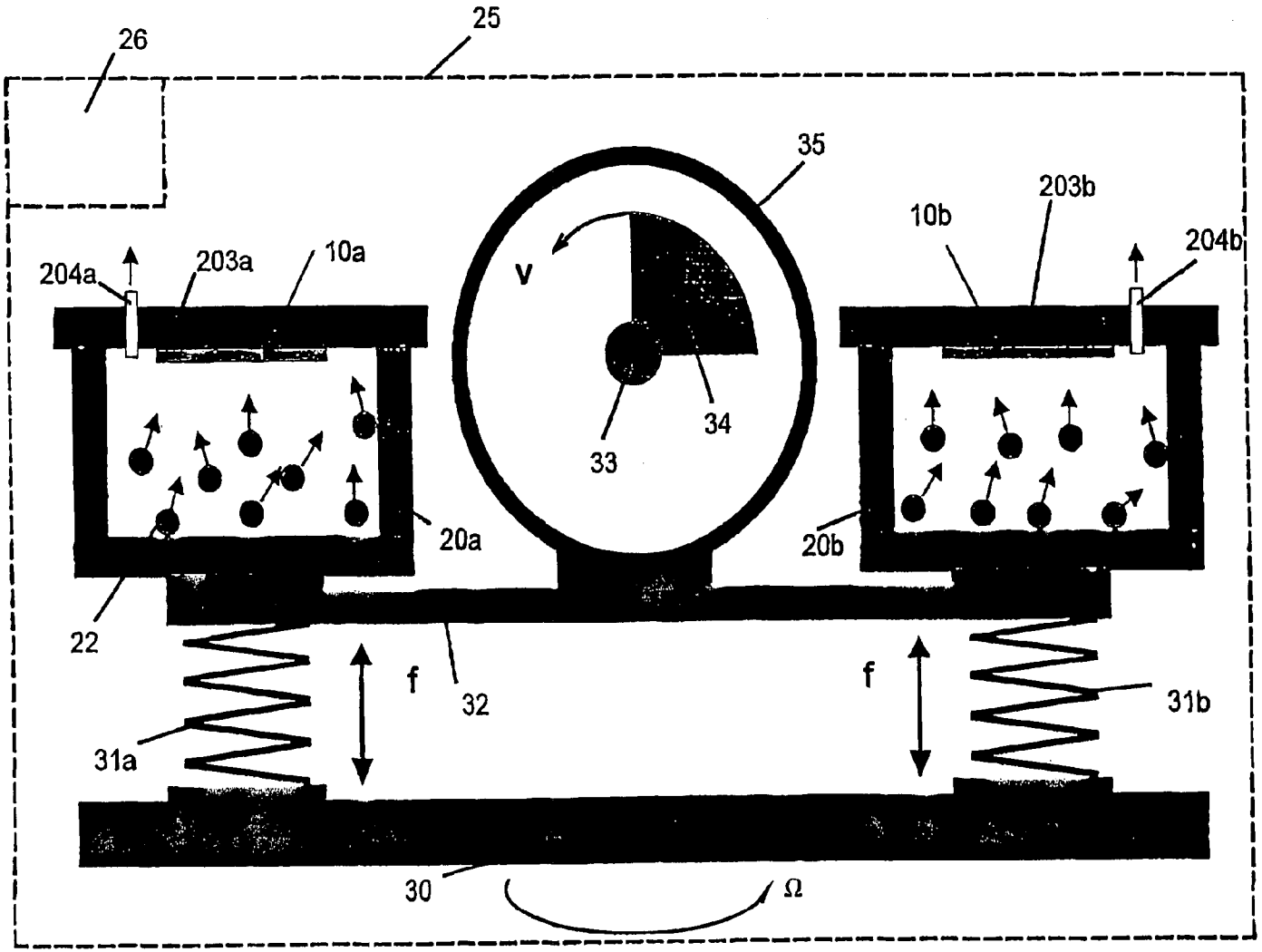
FIG. 1 represents a cross sectional diagram of the mechanical method [for generating] nanostructures according to the invention.

In order to reduce the size of the grains on an entire surface, it is necessary to create on the surface of the material a plastic deformation in all directions in a random fashion, according to the processes and with the devices defined in connection with FIG. 1.

FIG. 1 represents a diagram of a mechanical device for generating nanostructures by ball milling. The principle of the generation of nanostructures by ball milling according to FIG. 1 is to set a quantity of perfectly spherical balls (22) in motion at a given speed in order to communicate to them a kinetic energy that allows them to strike the same point on the surface to be treated at variable angles of incidence, with enough energy to create nanostructures.

DESCRIPTION OF THE PREFERRED EMBODIMENT(S)

The balls (22) chosen to strike the surface (10) to be treated are perfectly spherical and of high quality. For example, the balls (22) chosen are ball bearing balls. Given their quality, they are used in a given quantity. The use of perfectly spherical steel, glass or ceramic balls (22) makes it possible to prevent the localized accumulation of stress which could cause damage to the material from the impact of the ball. This perfect sphericity makes it possible to generate a plastic deformation of the surface of the material during the process for forming the nanostructured layer. Repeated multidirectional plastic deformations cause a fractionation of the grains of the metal or alloy of the piece to be treated, and hence a reduction in their size. An exemplary embodiment of the invention represented in FIG. 1 is constituted by an arm or plate (32) supporting a bowl at least one end; in the case of the figure, two bowls are shown at two ends of the arm (32). This arm (32) is linked to a structure (35) comprising a motor, not visible, that drives a shaft (33) on which is mounted an inertial piece (34) constituted, for example, by a mass in the shape of a sector of a circle (34). The motor driving the shaft (33) gives this inertial mass a speed V which, given the dissymmetry, generates a vibration in the structure (35), which is communicated through its link with the arm (32). This vibration is transmitted by the arm (32) to each bowl (20*a*, 20*b*). This structure constituted by the arm of the inertial system and by at least one bowl is mounted one or more shock absorbing means (31*a*, 31*b*); in this case, in the exemplary embodiment, shock absorbing means are disposed beneath each of the bowls in order to impart a symmetry of motion and thereby more easily control the vibrations generated. These shock absorbing means (31*a*, 31*b*) are supported by a plate (30) that is driven in a rotational motion in one direction by rotational drive means, not represented. The vibrating motion communicated by the inertial system (33, 34, 35) or bowls (20*a*, 20*b*) is in a direction that is approximately perpendicular to the plane of the plate, or in other words, parallel to the axis of rotation of the plate. The frequency of the vibrations and the amplitude of these vibrations are adapted based on the rotation speed of the plate, in order to communicate to the balls a given speed that allows them to acquire enough kinetic energy to create nanostructures. The balls (22) draw their energy from the motion of the bowl and will hit the surface of the piece (10) a large number of times at variable and multiple angles of incidence, creating with each impact a plastic deformation of the grains constituted by an agglomerate of molecules of the material or alloy. A ball that loses its energy in contact with the piece (10) bounces off the walls of the bowl (20) so as to acquire a new speed in a direction which, seen from the piece, seems random but is determined by physical laws. The bowl (20) can be closed, either by the piece (10*a*), which in that case constitutes a cover for the bowl, or by a cover (203*a*, 203*b*) to which the piece (10*a*) is attached. The latter variant makes it possible to produce in the closed chamber constituted by the bowl (20*a* or 20*b*, respectively) and its associated cover (203*a* or 203*b*, respectively), an opening (204*a* or 204*b*, respectively) that makes it possible to create a vacuum inside this enclosure in order to promote the movement of the balls.

In a variant of embodiment, it is possible to attach the piece to any other wall of the bowl, and possibly to have the piece play the role of the bowl if its geometry lends itself to that. Likewise, it is possible to provide a space between the bowl and the cover, as long as it does not exceed the size of the balls. Thus, the chamber is considered to be closed for the size of the balls.

In another variant of embodiment of the invention, the inertial system (33, 34, 35) can be replaced by a sonotrode that communicates to the arm (32) a vibration of sufficient amplitude and frequency. In this case, it would be quite possible to use frequencies that are outside the ultrasonic spectrum, the frequency of the vibration being determined based on the rotation speed of the assembly of the mass and on the size of the balls in order to allow the communication of sufficient kinetic energy to the balls.

Lastly, when wishing to obtain a nanostructured thickness from several tens to several hundred microns, the surface of the piece to be treated can be placed under stress.

Figure 2A:
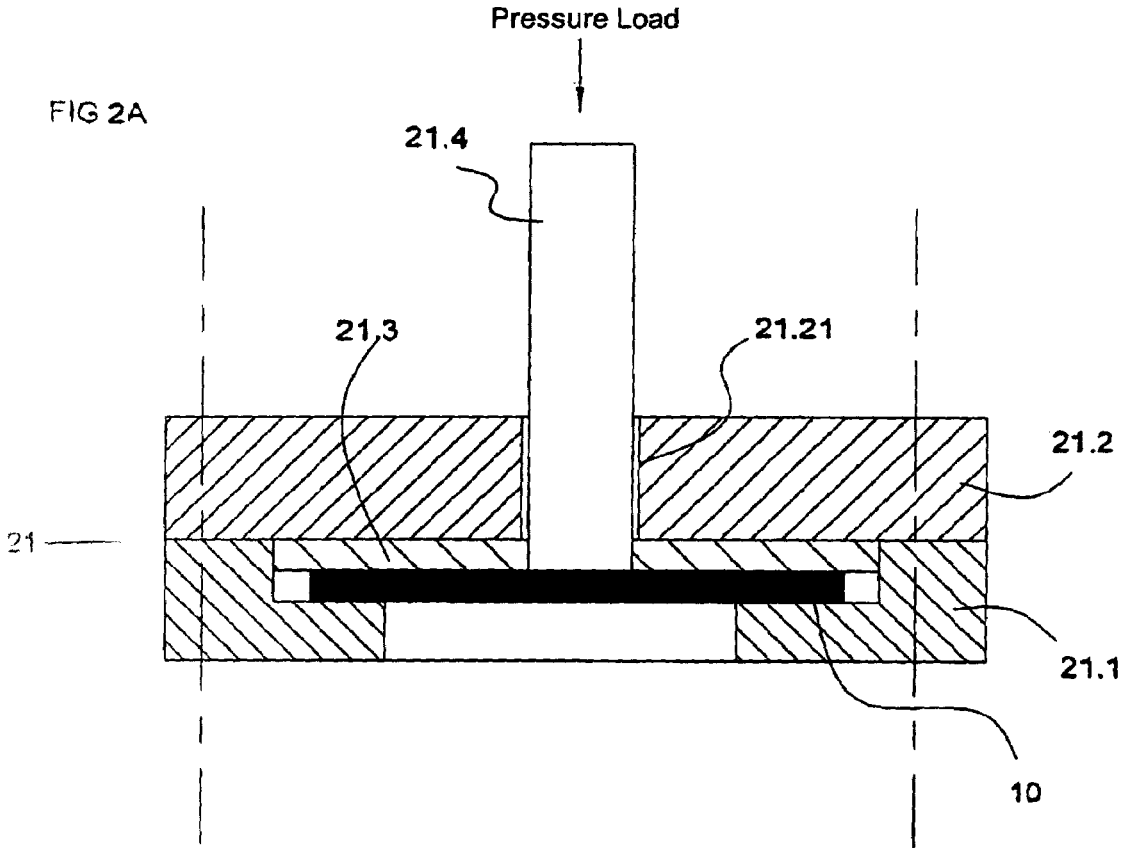
FIG. 2A represents a cross-section of a variant of embodiment of the device in which stress is applied.
Figure 2B:
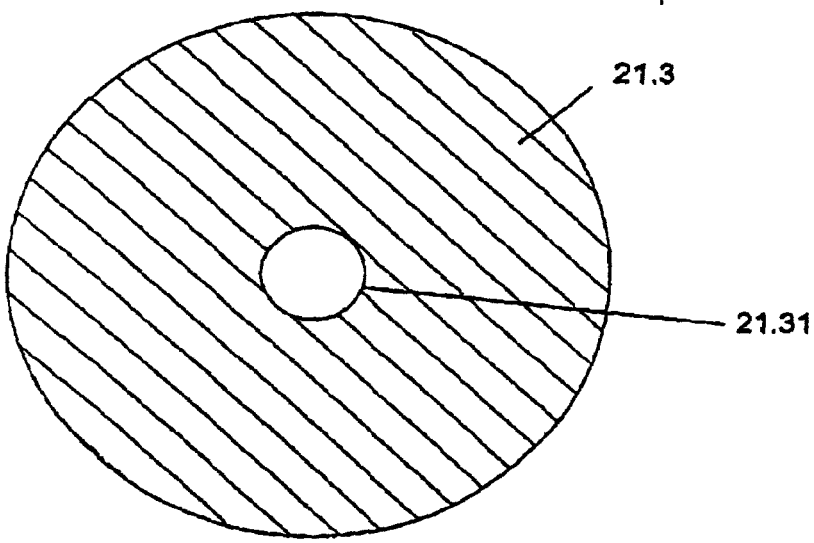
FIG. 2B represents a sectional top view of the shim used in the variant of embodiment of the invention in which stress is applied.

According to a variant of embodiment represented in FIG. 2, the surface to be treated can be placed under mechanical stress, for example by clamping the piece (10) with appropriate gripping means (21). These gripping means are, for example, constituted by a base plate (21.2) on which are mounted clamps (21.1) for clamping the piece against a protective shim (21.3) inserted between the piece (10) and the base plate (21.2). A rod (21.4) passing through the bores (21.21 and 21.31) in the base plate (21.2) and the shim (21.3) applies a load to the piece (10) retained by the clamps (21.1).

The pressure load can be obtained by threading the rod 21.4 and screwing it into a threaded hole (21.21) formed in the base plate (21.2).

The invention is not limited to the embodiments described, but encompasses any embodiment that makes it possible to apply mechanical stress to one or more places on a piece. Thus, several rods can be provided in order to apply different stresses in several places so as to obtain different nanostructured thicknesses, proportional to the value of the stresses applied at the respective points.

Figure 3A:
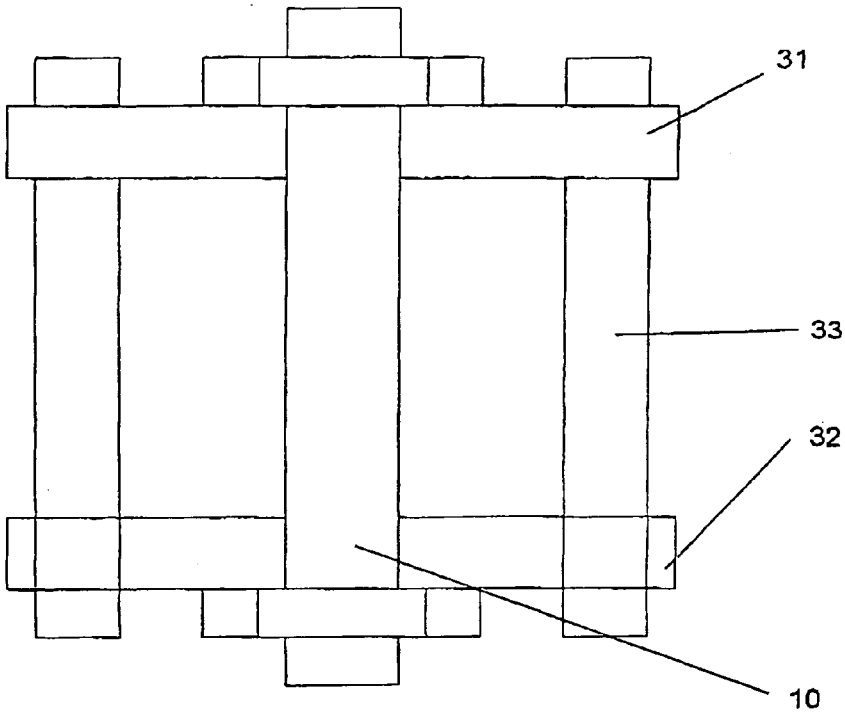
FIG. 3A represents an elevation of a second variant of embodiment of the invention in which stress is applied.
Figure 3B:
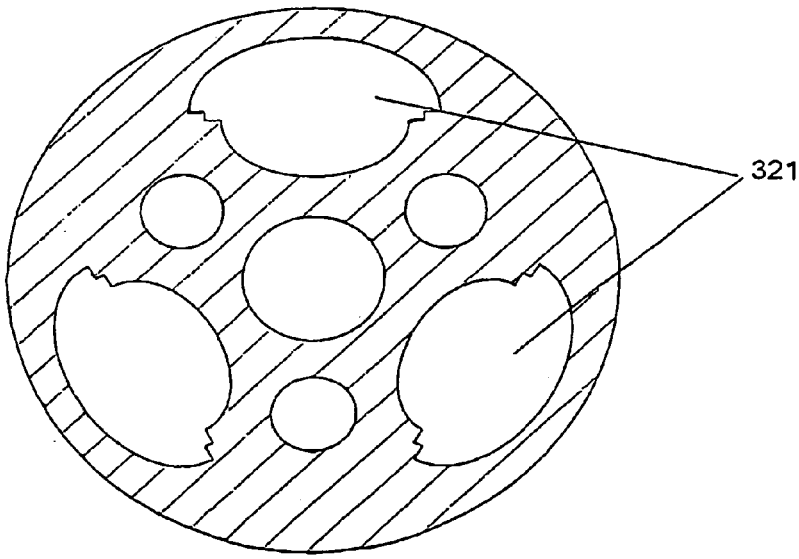
FIG. 3B represents a top view of the bottom plate of the second variant of embodiment with stress.

In the embodiment of the stressing device represented in FIG. 3A, means for exerting traction on each of the ends of the piece make it possible to place it under stress. These means are constituted, for example, by a top plate (31) and a bottom plate (32) held apart at a distance adjustable by means of three screw rods (33) disposed at 120° and exerting tractional stress on the ends of the piece joined to each plate. The piece can, for example, pass through each plate via openings and press against the outward-facing surface of each plate by means of rings forming shoulders and joined to the ends of the piece by a locking screw at a right angle to the ring. The plates, particularly the one (32) facing the projectile emission area, are provided, as represented in FIG. 3B, with cutouts that allow the circulation and the projection of the balls.

In another variant of embodiment, the stress applied can be thermal. Thus, the surface to be treated is heated, either completely so as to obtain a uniform thickness of nanocrystalline structures on the entire surface of the piece subjected to the ball bombardment, or locally so as to obtain variations in the thickness of nanocrystalline structures. In this case, means for heating by radiation, conduction or convection are installed in the bowl, on the piece, or in the acoustic chamber of the machine.

In addition, it is possible to combine the mechanical stress with a heating of the surface to be treated in order to obtain the desired result. The purpose of applying stress and/or raising the temperature is to allow the generation of the plastic deformation in the underlying layer and in all directions, so as to promote the fractionation of the grains of material located at a depth.

Tests currently performed by treating an unstressed piece have made it possible to produce nanostructured layers running from 20 μm to 50 μm by applying stress. Nanostructures are thereby obtained in a thickness of several hundred microns. The increase in the thickness of the nanostructured layer can be produced by finding a compromise between the value of the stress and the increase in the temperature. The choice of the various parameters involved in the method for generating nanostructures is also important.

Thus, experience has shown that the larger the diameter of the balls used, within a range of dimensions on the order of a few hundred microns to a few millimeters, the larger the nanostructured layer obtained. Likewise, the treatment time is involved in determining the thickness of the nanostructure. It has been noted that up to a given time value, which is different depending on the size of the balls, the more the time increases, the more the thickness of the nanostructured layer increases up to a time that corresponds to saturation and allows no further modification of the thickness of the layer. This given value is obtained either through experience, or from a mathematical model for a given material. However, when the time becomes greater than the given value, the thickness of the nanostructured layer decreases. This phenomenon is due to the fact that the impact of the balls on the surface to be treated generates an emission of heat, which heats up the material. Beginning at a certain threshold, the result of the heat is to increase the size of the metal grains.

The general principle for choosing the parameters of the method for generating nanostructures according to the invention is that the greater the kinetic energy of the balls, the greater the level of stress generated in the underlying layer. The upper limit of the kinetic energy is defined particularly by the heating caused by the release of this kinetic energy during the impact on the surface to be treated, and by the mechanical strength of the balls and of the material constituting the piece. This drawback can be mitigated or eliminated by cooling the chamber or the piece with a cooling system. In essence, as explained above, a temperature increase tends to enlarge the metal grains, and the material must not crack.

Other parameters may be acted on in order to obtain larger nanostructured layers or to reduce the treatment time. For example, the hardness of the balls plays a role, particularly in the transfer of kinetic energy from the ball to the surface of the piece. Likewise, when an ultrasonic generator is used to set the balls in motion, the acoustic pressure generated by the sound waves also influences the nanostructure generating process. Likewise, according to the invention, the ultrasonic generation of nanostructures the projection of streams of balls can be achieved in a medium containing a specific given gas that modifies the mechanical behavior or the chemical composition of the surface of the material during the impacts of the balls.

For example, in order to obtain a nanostructured layer of about 20 μm, it is necessary to expose the surface to be treated to an ultrasonic generation of nanostructures for 2 to 3 minutes using balls of 3 mm in diameter. Likewise, in order to obtain a nanostructured layer of about 10 μm, it is necessary to expose the surface to be treated to an ultrasonic generation of nanostructures for about 400s with balls of 300 μm in diameter. Likewise, experience has shown that the treatment time for generating nanostructures is between 50 and 1300s for conventional metal materials (Fe, Ti, Ni, Al, Cu, etc.). The total time required may be prolonged or reduced depending on the material. The diameter of the balls used is between 300 μm and 3 mm. In essence, for a given ball size and a given material, the nanostructure generating time is determined based on the nanostructured thickness desired by the user.

Finally, if necessary for acoustical or security reasons, the entire mechanism can be disposed inside an acoustic chamber (25), making it possible to reduce the noise so as to make it compatible with the acceptable standards for this work. This chamber (25) can be sealed and provided with diffusing or vaporizing means (26) (represented by dotted lines), making it possible to perform one or more of the chemical or thermochemical treatments described below. In this case, the bowl, because of its circulation channel (204*a*, 204*b*) allows the penetration of chemical or thermochemical treatments. Thus, depending on the physicochemical properties of the piece to be treated, it may be useful to treat it once either in a vacuum, or in an inert atmosphere, for example in order to prevent oxidation, then again with the diffusion of specific chemical compounds that are advantageous for the piece. The generation of nanostructures on the treated surface of the piece (10) causes a modification of the law of diffusion in the treated area by multiplying the number of boundaries between the grains, these boundaries constituting nanometric channels that allow the diffusion of chemical compounds having a size on the order of several atoms. This allows a better penetration of the chemical compounds.

Thus, all of the surface treatment methods involving the diffusion of compounds into the surface of a metal piece are modified when the piece has been previously subjected to the method for generating nanostructures according to the invention, or is subjected to the method for generating nanostructures at the same time.

Figure 4A:
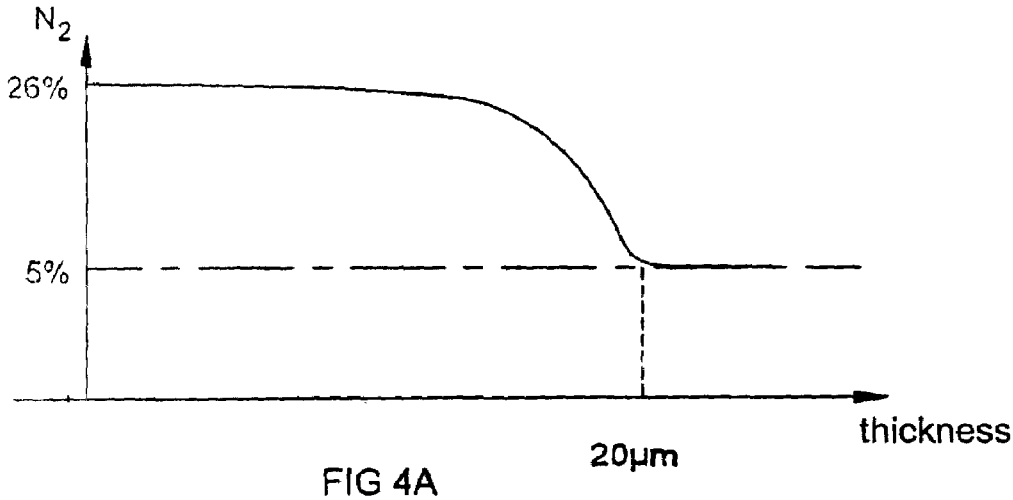
FIGS. 4A and 4B represent the curve representing the level and the penetration of nitrogen during an ion nitriding treatment in a piece treated using the method for generating nanostructures according to the invention, for a temperature of 550° C. and 350° C., respectively.
Figure 4B:
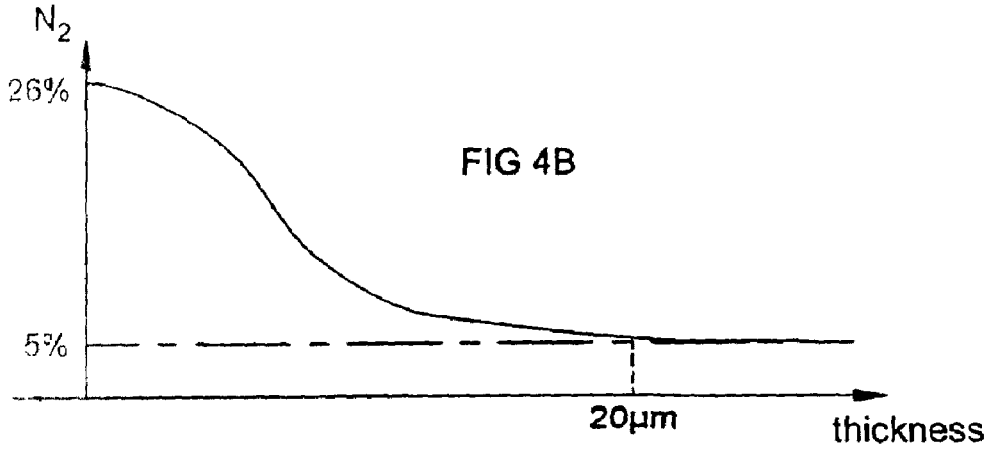

As an example, FIGS. 4A and 4B represent the curve representing the level and the penetration of nitrogen during an ion nitriding for a temperature of 550° C. and 350° C. The curve represented in FIG. 4A corresponds to the measurement of the level of nitrogen as a function of the thickness of the treated surface, when the piece has been subjected to a nitriding for two hours at a temperature of 550° C. The solid curve corresponds to the measurement produced for a surface pre-treated using the method for generating nanostructures according to the invention. The treatment for generating nanostructures on the surface made it possible to obtain a nanostructure in a thickness of about 20 μm. The dot-and-dash curve corresponds to the measurement produced for a surface not treated by generating nanostructures. We can see from the dot-and-dash curve that according to the prior art, the level of nitrogen that has penetrated for the nitriding treatment at 550° C. is uniform in the thickness of the piece and is equal to 5%. For the piece pre-treated by generating nanostructures according to the invention, the level of nitrogen, under the same operating conditions, is much higher, i.e., five times greater than the level in the untreated piece, in the thickness in which the nanostructures have been formed. After that, in the thickness of the piece that does not include any nanostructures, the level of nitrogen decreases rapidly to a level corresponding to the level obtained in the nitriding method of the prior art. This treatment makes it possible to obtain microstructures of material that are more advantageous in terms of fatigue, fretting fatigue and contact fatigue.

The curve represented in FIG. 4B corresponds to the measurement of the level of nitrogen as a function of the thickness of the treated surface when the piece has been subjected to a nitriding for two hours at a temperature of 350° C. The solid curve corresponds to the measurement produced for a surface pre-treated using the method for generating nanostructures according to the invention. The dot-and-dash curve corresponds to the measurement produced for a surface not treated by generating nanostructures. The treatment for generating nanostructures on the surface made it possible to obtain a nanostructure in a thickness of 20 μm. We can see that according to the prior art, the level of nitrogen is uniform in the thickness of the piece and is equal to 1%. This level is much too low to satisfactorily modify the mechanical properties of the surface of the piece.

For the piece pre-treated by generating nanostructures according to the invention, the level of nitrogen is 17 times greater than the level in the piece whose surface is untreated. After that, the level of nitrogen gradually decreases in the thickness of the piece comprising the nanostructure, and ends up being equal to the level obtained according to the nitriding process of the prior art where the layer of the piece does not include any nanostructures.

It should be noted that the nitriding process according to the prior art can only be performed beginning at a certain temperature, near 550° C. for a piece made of steel or carbon. It is therefore clear that pre-treating the piece makes it possible not only to obtain a good structure on the surface of a piece, but also to lower the treatment temperature while retaining, in the case of the treatment at 350° C., a level of nitrogen greater than the level obtained without treatment by generating nanostructures according to the invention.

Thus, with the lowering of the treatment temperature, it becomes possible to perform nitriding on pieces which, in the prior art, could not be subjected to nitriding. In fact, nitriding must be performed at a temperature of approximately 550° C., although at this temperature a metal piece is necessarily subject to deformation. For pieces in which geometric precision is essential, such deformation is unacceptable, and consequently prohibits any nitriding according to the method of the prior art. By applying the method for generating nanostructures according to the invention prior to the nitriding, it is possible to lower the treatment temperature and hence to reduce or eliminate the deformation of the piece. As a result, precision pieces can be subjected to nitriding, which was impossible in the prior art.

Likewise, the pre-treatment according to the method of the invention for generating nanostructures also makes it possible to reduce the treatment time. In fact, the presence of nanostructures, and in particular nanometric diffusion channels, allows faster diffusion of the compounds into the superficial layer of the piece.

That which is explained above for nitriding is also true for any surface treatment or physicochemical surfacing method that depends on the law of diffusion in the superficial layer of a piece. Thus, methods for case hardening or ion catalysis or storage in a metal structure are modified when the piece has been previously subjected to the process for generating nanostructures according to the invention, i.e., when it comprises a layer of nanometric microstructures in a thickness of ten or several tens of microns.

Thus, the mechanical method for generating microstructures according to the invention is characterized by the fact that it comprises:

a step for setting in a circular motion a quantity of perfectly spherical balls (22) disposed in a chamber that is closed for the size of the balls, at least one of whose walls supports or constitutes the piece to be treated (10);

a step for imparting a vibrating motion in a direction perpendicular to the plane of the circulating motion of the chamber supporting or constituting the piece to be treated; the speed of the circular motion and the frequency and amplitude of the vibrating motion being determined based on the physical properties of the balls so as to communicate to the latter sufficient kinetic energy to create nanostructures on the material of the piece to be treated.

In another embodiment, the method includes a step for placing the metal piece (10) to be treated under mechanical and/or thermal stress.

In another embodiment, the method includes a step for treatment by diffusion of chemical compounds and by formation of new phases of materials of different composition in the nanostructured layer generated, either during the generation of the nanostructures or after the generation of same.

In another embodiment, the treatment time is between several seconds and 10 hours.

In another embodiment, the size of the balls varies from 3 to 10 mm.

In another embodiment, the treatment step is a nitriding comprising a placement of the piece (10) to be treated in a nitrogen atmosphere, at a given temperature between 350° and 550° C., for a given amount of time between 30 min. and 10 h.

In another embodiment, the treatment step is a case hardening or an ion catalysis or storage in the metallic structure of the piece.

In another embodiment, the step for imparting a vibrating motion is performed by means of an electronic vibrator whose waves cause the chambers to move in the desired direction.

In another embodiment, the vibrator is an ultrasonic generator.

In another embodiment, the diameter of the perfectly spherical balls (22) is between 300 μm and 3 mm, depending on the desired thickness of the nanostructured layer.

In another embodiment, for a given ball size, a given material constituting the piece (10) and a given machine configuration, the projection time is determined based on the nanostructured thickness desired by the user.

In another embodiment, the projection time of the balls (22) is between 30 and 1300s.

In another embodiment, the method includes a step for cooling the piece to be treated.

In another embodiment, the speed of the balls is between 5 and 100 mps.

Finally, the mechanical device for generating nanostructures in given thickness of a metal piece (10) comprising at least one chamber that is closed for the size of the balls containing a given quantity of perfectly spherical balls of given dimensions, a means for linking the chamber with means for generating a vibration communicated to the chamber, the assembly of the chamber and vibrating means being mounted by shock absorbing means (31) on a plate (30) that rotates at a given speed.

In another embodiment, the device includes means for adjusting the rotation speed of the plate and means for adjusting the frequency and the amplitude of the means for adjusting the vibration.

In another embodiment, the vibration generating means is an ultrasonic generator.

In another embodiment, the vibration generating means is constituted by an inertial assembly (34) driven in rotation around a shaft (33) perpendicular to the axis of rotation of the plate, the inertial assembly being mechanically linked to the means (32) for linking with the chamber (20*a*, 20*b*).

In another embodiment, the device includes means for placing the metal piece (10) under stress and/or means for heating the piece (10).

In another embodiment, the device includes means for adjusting the distance (d) between the ball emitting source and the piece to be treated.

In another embodiment, the distance is on the order of 4 to 40 mm.

In another embodiment, the device includes means for adjusting the emission time of the balls and their speed.

In another embodiment, the balls are of a quantity such that, when the means for setting them in motion using ultrasound are inactive, they occupy a surface area greater than 30% of the surface of the sonotrode.

In another embodiment, the speed is between 5 and 100 mps.

In another embodiment, the device includes means for performing a local cooling of the treated area of the piece.

In another embodiment, the device includes means for treatment by diffusion of chemical compounds in the nanostructured layer generated, either during the generation of the nanostructures or after the generation of same.

In another embodiment, the device includes means for placing the piece (10) to be treated in a nitrogen atmosphere, at a given temperature between 350 and 550° C., for a given amount of time between 30 min and 10 h.

In another embodiment, the device includes means for case hardening, carbonitration and other thermochemical treatments.

In another embodiment, the device is enclosed in an acoustic isolation chamber (25).

It should be clear to those skilled in the art that the present invention allows for embodiments in many other specific forms without going beyond the scope of application of the invention as claimed. Consequently, the present embodiments should be considered illustrative, but can be modified within the range defined by the scope of the attached claims, and the invention should not be limited to the details given above.

We claim:

1. A mechanical method for generating nanostructures in order to obtain on a surface of a metal piece a nanostructure layer of defined thickness, comprising:

setting a chamber in which is disposed a quantity of perfectly spherical balls into circular motion, the chamber being closed for the size of the balls and containing the metal piece to be treated;

imparting a vibrating motion in a direction perpendicular to the plane of the circular motion of the chamber, such that spherical balls are projected to impact on the surface of the metal piece within the chamber;

the speed of the circular motion and the frequency and amplitude of the vibrating motion being determined based on the physical properties of the balls so as to communicate to the latter sufficient kinetic energy to create a nanostructure on the surface of the piece to be treated, wherein the diffusion and forming of new phases is done during the formation of the nanostructure.

2. A mechanical method for generating nanostructures in order to obtain on a surface of a metal piece a nanostructure layer of defined thickness, comprising:

setting a chamber in which is disposed a quantity of perfectly spherical balls into circular motion, the chamber being closed for the size of the balls and containing the metal piece to be treated;

imparting a vibrating motion in a direction perpendicular to the plane of the circular motion of the chamber, such that spherical balls are projected to impact on the surface of the metal piece within the chamber;

the speed of the circular motion and the frequency and amplitude of the vibrating motion being determined based on the physical properties of the balls so as to communicate to the latter sufficient kinetic energy to create a nanostructure on the surface of the piece to be treated; and diffusing chemical compounds into the nanostructure layer and forming of new phases of materials of different composition in the nanostructured layer generated.

3. A mechanical device for generating nanostructures in a metal piece comprising at least one chamber that is closed for the size of the balls containing a given quantity of perfectly spherical balls of given dimensions, means for linking the chamber with means for generating a vibration communicated to the chamber, the assembly of the chamber and vibrating means being mounted on shock absorbing means on a plate adapted to be rotated at a given speed.

4. A device according to claim 3, further including means for adjusting the rotation speed of the plate and means for adjusting the frequency and the amplitude of the vibration generating means.

5. A device according to claim 3, characterized in that the vibration generating means is an ultrasonic generator.

6. A device according to claim 3, characterized in that the vibration generating means is constituted by an inertial assembly driven in rotation around a shaft perpendicular to the axis of rotation of the plate, the inertial assembly being mechanically linked to the means for linking with the chamber.

7. A mechanical device for generating nanostructures in a given thickness of a metal piece according to claim 3, further including means for placing the metal piece under stress.

8. A mechanical device for generating nanostructures in a given thickness of a metal piece according to claim 7, further including means for heating the piece.

9. A device for generating nanostructures in a given thickness of a metal piece according to claim 3, characterized in that it includes means for adjusting the distance (d) between a ball emitting source and the piece to be treated.

10. A device for generating nanostructures in a given thickness of a metal piece according to claim 9, characterized in that the distance is on the order of 4 to 40 mm.

11. A device for generating nanostructures in a given thickness of a metal piece according to claim 9, characterized in that it includes means for adjusting the emission time of the balls and their speed from the emitting source.

12. A device for generating nanostructures in a given thickness of a metal piece according to claim 11, characterized in that the speed of the balls is between 5 and 100 mps.

13. A device for generating nanostructures in a given thickness of a metal piece according to claim 3, characterized in that it includes means for performing a local cooling of the treated area of the piece.

14. A device for generating nanostructures according to claim 13, characterized in that it includes means for treating the metal piece by diffusion of chemical compounds in the nanostructured layer generated, either during the generation of the nanostructures or after the generation of same.

15. A device for generating nanostructures in a given thickness of a metal piece according to claim 3, characterized in that it includes means for placing the piece to be treated in a nitrogen atmosphere, at a given temperature between 350 and 550° C., for a given amount of time between 30 min. and 10 h.

16. A device for generating nanostructures in a given thickness of a metal piece according to claim 3, characterized in that it includes means for case hardening, carbonitration, and thermochemical treatment.

17. A device for generating nanostructures in a given thickness of a metal piece according to claim 3, characterized in that the device is enclosed in an acoustic isolation chamber (25).

* * * * *

UNITED STATES PATENT AND TRADEMARK OFFICE

CERTIFICATE OF CORRECTION

PATENT NO. : 7,147,726 B2
APPLICATION NO. : 10/343012
DATED : December 12, 2006
INVENTOR(S) : Jian Lu It is certified that error appears in the above-identified patent and that said Letters Patent is hereby corrected as shown below:

Column 10, Line 31 after the word "treated", please add the following which was omitted from original Claim 32:

--placing the metal piece to be treated under one or more of mechanical or thermal stress; and diffusing chemical compounds into the nanostructure layer and forming of new phases of materials of different composition in the nanostructured layer generated--.

Column 10, Line 54 after the word "generated", please add the following sentence which was omitted from original Claim 33:

--wherein the diffusion and forming of new phases is done during the formation of the nanostructure--.

Signed and Sealed this

Twenty-first Day of August, 2007

JON W. DUDAS
*Director of the United States Patent and Trademark Office*